US008075418B2

(12) United States Patent
Jahangiri

(10) Patent No.: US 8,075,418 B2
(45) Date of Patent: Dec. 13, 2011

(54) ENERGY ABSORBING DEVICE FOR SPORTING EQUIPMENT

(76) Inventor: Farhad Fred Jahangiri, Calabasas, CA (US)

( * ) Notice: Subject to any disclaimer, the term of this patent is extended or adjusted under 35 U.S.C. 154(b) by 0 days.

(21) Appl. No.: 11/426,749

(22) Filed: Jun. 27, 2006

(65) Prior Publication Data

US 2007/0243948 A1 Oct. 18, 2007

Related U.S. Application Data

(60) Provisional application No. 60/792,598, filed on Apr. 17, 2006.

(51) Int. Cl.
*A63B 53/08* (2006.01)

(52) U.S. Cl. ..... 473/318

(58) Field of Classification Search ..... 473/258, 473/316–323, 256, 564–568, 520–523; 206/521.9
See application file for complete search history.

(56) References Cited

U.S. PATENT DOCUMENTS

| | | | | | |
|---|---|---|---|---|---|
| 1,418,038 | A * | 5/1922 | Tousey | 473/317 |
| 2,018,723 | A * | 10/1935 | Hutchison | 473/315 |
| 3,283,988 | A * | 11/1966 | Hardigg | 206/521 |
| 3,608,907 | A * | 9/1971 | Bouchard | 473/242 |
| 4,005,864 | A * | 2/1977 | Stewart | 473/437 |
| 4,373,718 | A * | 2/1983 | Schmidt | 473/538 |
| 4,390,922 | A * | 6/1983 | Pelliccia | 361/170 |
| 5,277,423 | A * | 1/1994 | Artus | 473/319 |
| 5,294,119 | A * | 3/1994 | Vincent et al. | 473/318 |
| 5,516,101 | A * | 5/1996 | Peng | 473/523 |
| 5,993,325 | A * | 11/1999 | Heyer | 473/256 |
| 6,544,129 | B2 * | 4/2003 | Todd | 473/318 |
| 7,309,292 | B2 * | 12/2007 | Tu Teng | 473/256 |
| 2005/0043110 | A1 * | 2/2005 | Lindsey | 473/300 |
| 2005/0245324 | A1 * | 11/2005 | Light | 473/256 |

FOREIGN PATENT DOCUMENTS

WO WO 01/47612 A1 * 7/2001

* cited by examiner

*Primary Examiner* — Stephen L. Blau
(74) *Attorney, Agent, or Firm* — Joseph R. Cruse, Jr.; Law Offices of Joseph Cruse, Jr.

(57) ABSTRACT

An energy absorbing apparatus for sport's equipment which comprises a helix that is capable of securing sports equipment along its length and reducing the shock and vibration transferred from the striking object to the person.

4 Claims, 5 Drawing Sheets

ENERGY ABSORBING DEVICE FOR SPORTING EQUIPMENT

CROSS-REFERENCE TO RELATED APPLICATIONS

This Application claims the benefit of Provisional Patent Application Ser. No. 60/792,598 filed Apr. 17, 2006

FEDERALLY SPONSORED RESEARCH

Not Applicable

SEQUENCE LISTING OF PROGRAM

Not Applicable

FIELD OF THE INVENTION

The present invention relates to at least sports equipment, and more particularly relates to at least a device for absorbing energy generated from a golf club, baseball bat, hockey, lacrosse stick or similar type of sport striking device.

BACKGROUND OF THE INVENTION

Athletes are constantly striving to improve their performances. Unfortunately, this results in pain while attempting to improve their performances. When an athlete strikes an object, such as a ball or puck with an object such as a club, bat or stick, shock and vibration results. Not only does this sometimes cause pain and damage to the athlete's bones and joints, the unwanted shock and vibration can reduce the athlete's feel A common scenario illustrates the problems mentioned above. A golfer or baseball player strikes the ball off-center. Excess vibration and shock will travel up the golf shaft or baseball bat unhindered and will be transmitted to the person's hands and body. At times, especially in colder weather, this pain can be intense.

In the worst cases, the process of hitting a golf or base ball improperly, will even cause the person to quit playing for the entire day. In other cases, time is lost while the player regains his feeling and strength in his grip.

Such scenarios occur with millions of amateur athletes. Tennis racquet manufacturers have developed a string mounted shock absorber. Golf club manufacturers have recently added shock and vibration reducing elements into the manufacture of their clubs.

In sum, the shock and vibration caused from the improper striking of a ball with a bat or club are harmful in many ways.

Therefore, a need exists for a device that reduces the shock and vibration when a athlete improperly strikes an object, thereby potentially causing severe pain to the athlete or otherwise damaging the athlete's joints. —OBJECTS AND ADVANTAGES Accordingly, besides the objects and advantages of the Energy Absorbing Device for Sporting Equipment described herein, several objects and advantages of the present invention are:

a) The present invention solves the above and other needs by securing an energy absorbing device to a piece of athletic equipment such as a golf club or a baseball bat.

b) An embodiment of the present invention secures the energy absorbing device to a piece of athletic equipment by wrapping it around the shaft of the athletic equipment. The device can be attached more securely to the equipment by using a common adhesive, such as double-sided tape or a liquid glue. The athletic equipment may be a golf-club, a baseball bat, or a hockey or lacrosse stick, or any other type of similar athletic equipment. The energy absorbing device may be constructed in whole or in part of molded or extruded rubber or any other material known to those of ordinary skill in the art.

c) The energy absorbing device may be molded or extruded in a long piece, and is wrapped around the outside of the fixed shaft of the athletic equipment. The energy absorbing device may be symmetrical or asymmetrical, in varying lengths and depths, as well as in numerous profiles, with or without cavities which may assist to more easily dissipate the shock.

d) The underside of the energy absorbing device may attach to the athletic equipment by simply wrapping the device around the equipment or employing double-sided tape, a liquid glue, or any other adhesive understood by one of skill in the art. The underside of the energy absorbing device is flat as to maximize the surface area in contact between the surface of the sports equipment and the energy absorbing device.

e) The interior portion of the device can be round, rectangular, oval, triangular or other shape as to wrap easily on the body of an athletic striking device.

Still further objects and advantages will become apparent from a consideration of the ensuing description and drawing.

SUMMARY

In accordance with the present invention an energy absorbing device for sports equipment that is capable of reducing shock and vibration from the striking element of sports equipment to the hands and joints of the athlete.

DRAWINGS

Figures

The above and other aspects of the present invention will be more apparent from the following more particular description thereof, presented in conjunction with the following drawings wherein.

DETAILED DESCRIPTION

The following detailed description is of the best mode presently contemplated for carrying out the invention. This description is not to be taken in a limiting sense, but is made merely for the purpose of describing the general principles of the invention.

Figure 1:
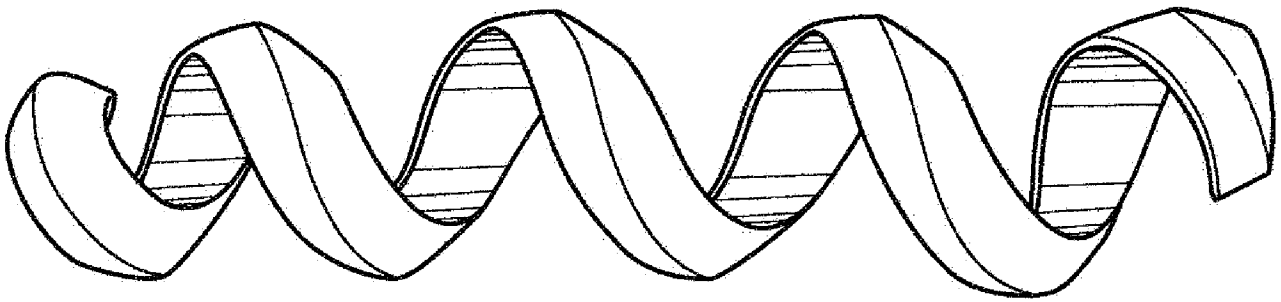
FIG. 1 is a perspective view of an embodiment of the present invention.

FIG. 1 shows a perspective view of an embodiment of the present invention. As shown in FIG. 1, an embodiment of the present invention includes a helix (11) of molded and formed material such as rubber. The helix (11) may also be constructed in whole or in part of one of, or a combination of, the following materials: rubber, plastic, silicone, or any material known to those of ordinary skill in the art.

The embodiment of FIG. 1 includes a flat smooth surface (12) on one side of the helix (11) so as to permit the helix (11) to be secured to the fixed surfaces of different pieces of athletic equipment. For example, the helix (11) may secure via the flat smooth surface (12) to a small diameter piece of athletic equipment such as the shaft of a golf club. Helix (11) may also secure via the flat smooth surface (12) to a larger diameter object such as a baseball bat or a hockey stick.

The present invention may be capable of securing to objects of varying diameters using at least one of a double-sided tape or liquid glue or any other adhesive understood by one of skill in the art. Such adhesives may be used in any combination or orientation.

Thus, the present invention contemplates embodiments that are capable of securing to multiple accessories along its length.

Figure 2:
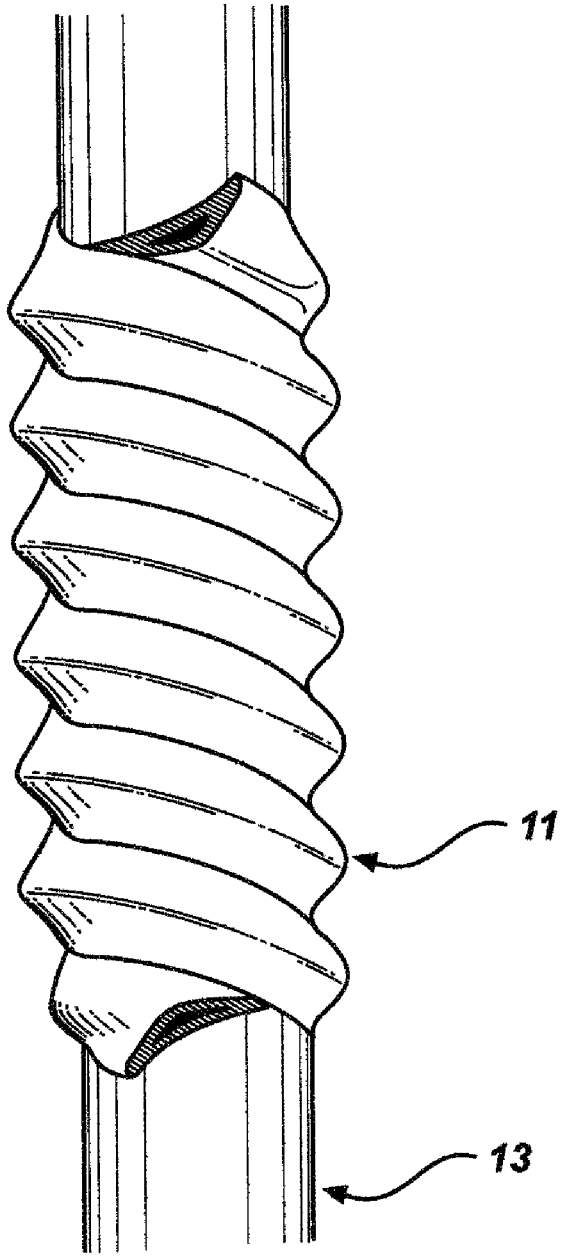
FIG. 2, is a side view of the present invention secured to the neck of a piece of athletic equipment, such as a hockey stick.

FIG. 2 shows a perspective view of an embodiment of the present invention secured to a fixed point, such as on the shaft of a golf club or baseball bat between the grip and the equipment's striking portion. As shown in FIG. 2, an embodiment of the present invention may be coiled around the shaft of the equipment (13), such as the shaft of a hockey stick. The length of the helix (11) is preferably long enough to coil around the shaft (13) several times in order to absorb the maximum amount of shock and vibration, yet, the length of the helix (11) is preferably short enough, so that it doesn't interfere with the grip or striking surface.

Figure 3:
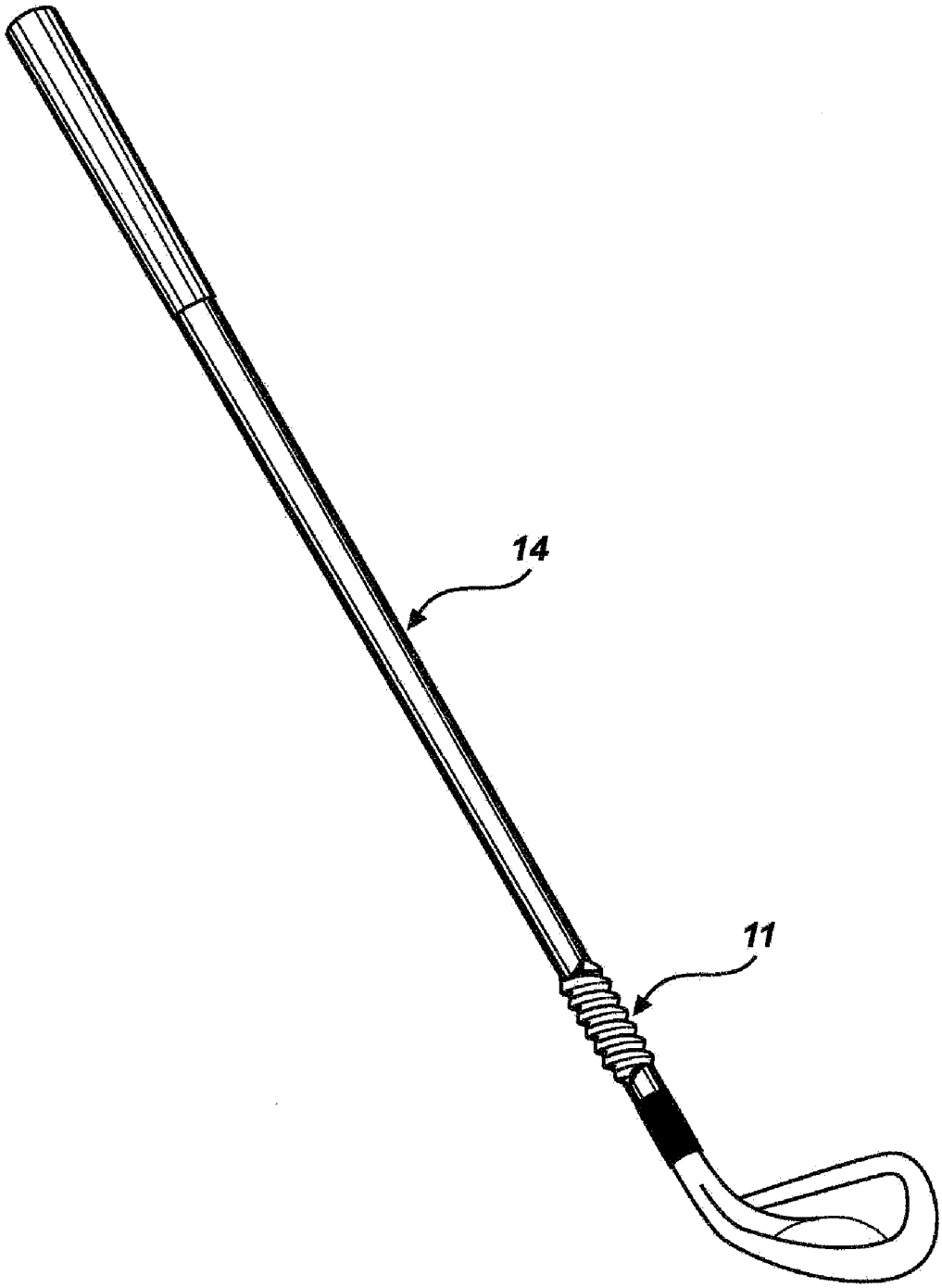
FIG. 3 is a side view of an embodiment of the present invention secured to a golf club.

FIG. 3 shows a side view of an embodiment of the present invention secured to the shaft of a golf club (14).

Figure 4:
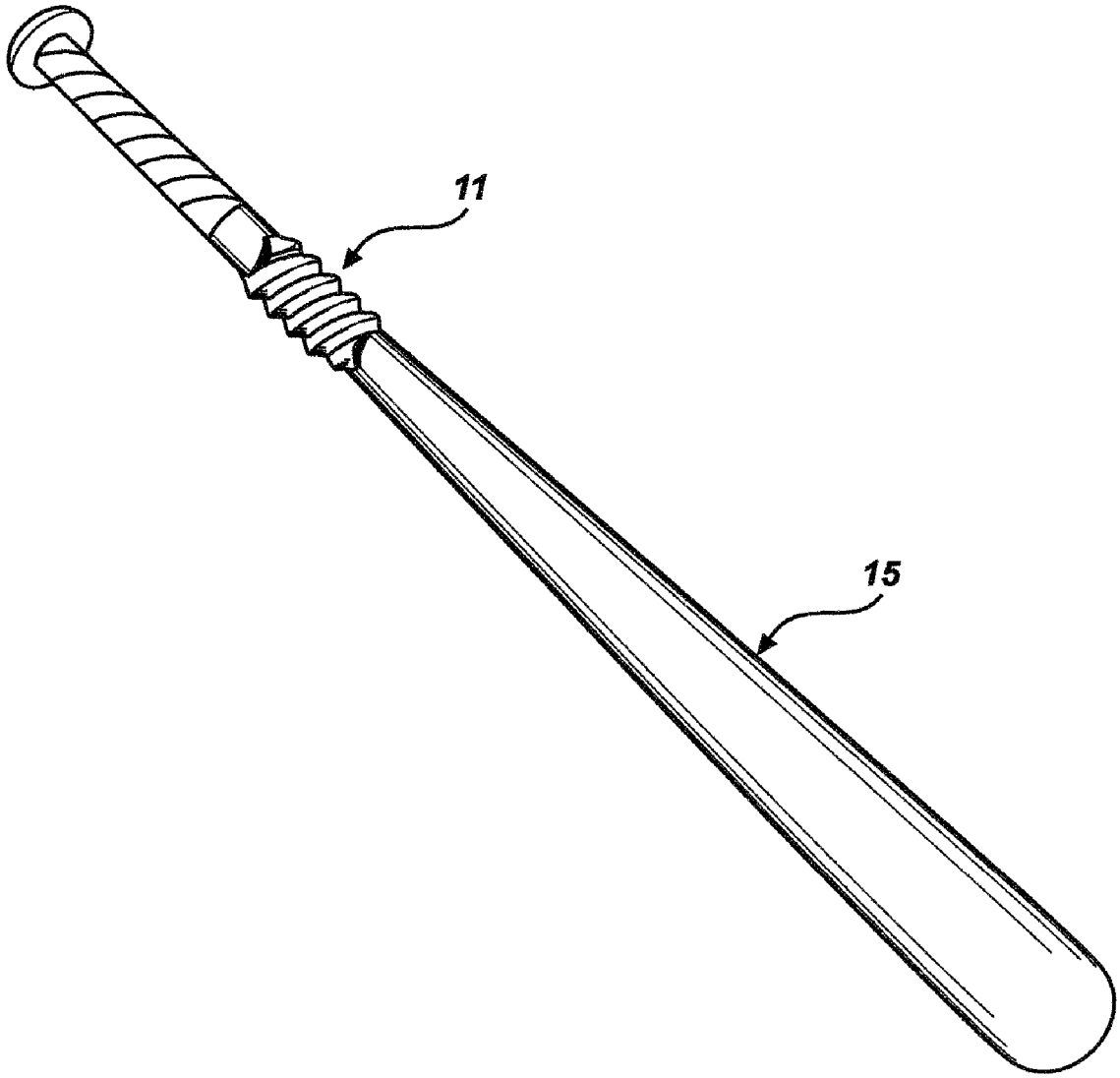
FIG. 4 is a side view of an embodiment of the present invention secured to a baseball bat.

FIG. 4 shows a side view of an embodiment of the present invention secured to the neck of a baseball bat (15).

Figure 5A:
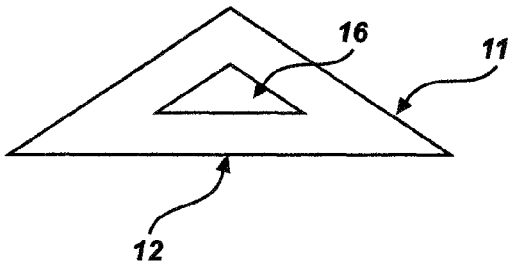
FIG. 5A is a cross-sectional view of an embodiment of the present invention in a hollow triangular shape.

FIG. 5A shows a cross-sectional view of an embodiment of the present invention in a hollow triangular shape (16).

Figure 5B:
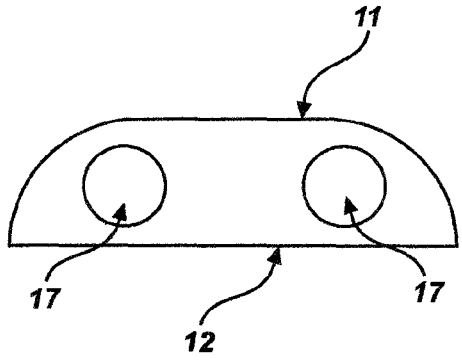
FIG. 5B is a cross-sectional view of an embodiment of the present invention in a hollow singular rounded shape.

FIG. 5B shows a cross-sectional view of an embodiment of the present invention in a hollow singular rounded shape (17).

Figure 5C:
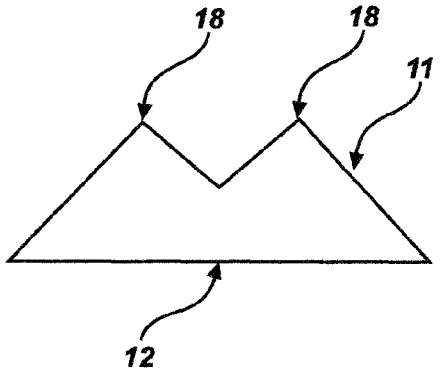
FIG. 5C is a cross-sectional view of an embodiment of the present invention in a solid pyramidal shape.

FIG. 5C shows a cross-sectional view of an embodiment of the present invention in a solid pyramidal shape (18).

Figure 5D:
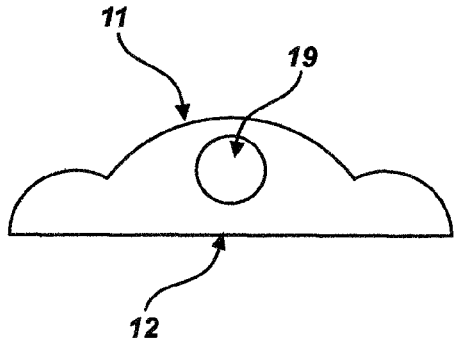
FIG. 5D is a cross-sectional view of an embodiment of the present invention in a hollow tri-rounded shape.

FIG. 5D shows a cross-sectional view of an embodiment of the present invention in a hollow tri-rounded shape (19).

I claim:

1. A non-metallic shock and vibration absorber for use on a sports striking device, said absorber comprising:

a flexible spiral elongated element, wherein the element has a length such that it is adapted to extend over and spirally wrap around the shaft of a sports device;

said element placed directly on the shaft above and adjacent to said striking device's grip, so as not to interfere with grip area or striking area;

said spiral elongated element is flexible so as to effect shock and vibration dampening;

wherein said spiral elongated element possesses opposing ends;

wherein said absorber is adapted to be spirally wrapped directly around the shaft of a sports device above and adjacent to the grip, so that underside of the absorber is in frictional contact with the shaft so that when said absorber is applied thereover, said absorber will remain on said shaft when force is applied thereto and thereby produce variable vibration dampening across the shaft of the striking device;

wherein said absorber is adapted to be spirally wrapped directly around the shaft of a sports device at least 5 turns;

wherein said absorber is adapted to be spirally wrapped directly around the shaft of a sports device without any gap between the turns;

wherein said absorber possesses a diameter that is less than the diameter of the shaft of a sports device; wherein said elongated element is molded in a spiral shape with a plurality of turns; and wherein said elongated element has a cross section shape being triangular or pyramidal in shape.

2. A non-metallic shock and vibration absorber according to claim 1, wherein said spiral elongated element is made solely of rubber.

3. A non-metallic shock and vibration absorber according to claim 1, wherein said elongated element is hollow.

4. A non-metallic shock and vibration absorber according to claim 1, wherein the underside of the elongated element possesses double side tape.

* * * * *